US005421424A

United States Patent [19]

Portwood et al.

[11] Patent Number: 5,421,424

[45] Date of Patent: Jun. 6, 1995

[54] BOWED OUT CHISEL INSERT FOR ROCK BITS

[75] Inventors: Gary Portwood, Katy; James C. Minikus, Spring; Scott D. McDonough, Houston; Michael A. Siracki, The Woodlands, all of Tex.

[73] Assignee: Smith International, Inc., Houston, Tex.

[21] Appl. No.: 257,592

[22] Filed: Jun. 9, 1994

[51] Int. Cl.[6] ..... E21B 10/16

[52] U.S. Cl. ..... 175/374; 175/426

[58] Field of Search ..... 175/374, 426

[56] References Cited

U.S. PATENT DOCUMENTS

| | | | |
|---|---|---|---|
| 3,442,342 | 5/1969 | McElya et al. | 175/374 |
| 4,058,177 | 11/1977 | Langford, Jr. et al. | 175/374 |
| 4,108,260 | 8/1978 | Bozarth | 175/374 |
| 4,716,977 | 1/1988 | Huffstutler | 175/426 |
| 4,722,405 | 2/1988 | Langford, Jr. | 175/374 |
| 4,854,405 | 8/1989 | Stroud | 175/426 |
| 5,201,376 | 4/1993 | Williams | 175/426 X |
| 5,322,138 | 6/1994 | Siracki | 175/374 |

FOREIGN PATENT DOCUMENTS

| | | | |
|---|---|---|---|
| 1086111 | 4/1984 | U.S.S.R. | 175/374 |
| 1216340 | 3/1986 | U.S.S.R. | 175/426 |

*Primary Examiner*—Hoang C. Dang

*Attorney, Agent, or Firm*—Robert M. Vargo

[57] ABSTRACT

A chisel type insert is disclosed having a contoured surface in which the vertical lines located on the surface are bowed outwardly in a convex manner thereby eliminating blend radii from the cutting tip and the high stress concentrations associated therewith.

7 Claims, 1 Drawing Sheet

BOWED OUT CHISEL INSERT FOR ROCK BITS

CROSS-REFERENCE TO RELATED APPLICATION

This application is related to Assignee's pending application Ser. No. 08/045,444, filed Apr. 8, 1993, now U.S. Pat. No. 5,322,138, which, in turn, is a Continuation-in-Part of application Ser. No. 744,777, filed Aug. 14, 1991, now abandoned.

BACKGROUND OF THE INVENTION

1. Field of the Invention

This invention relates generally to tungsten carbide insert rock bits, and more particularly, to the specially shaped and designed inserts utilized thereon.

2. Description of the Prior Art

Rock bits using sintered tungsten carbide inserts generally have a wedge or chisel-shaped configuration for soft to medium hard formations. Various embodiments of such configurations are shown in U.S. Pat. Nos. 3,442,342 and 4,108,260. Such chisel-shaped inserts conventionally have a cylindrical base for retention into the cone structure of the bit and a wedge-like cutting tip adapted to project beyond the cone surface. In all forms of chisel type inserts, flanks are made into the insert by removing material from two opposing sides of a truncated cone. A curvilinear crest formed from a tip radius connects to the top of the two flanks. The remaining truncated cone, a conical surface symmetric with the insert axis, is joined to the crest with two opposing corner radii that are revolved around the insert axis.

The flanks may be planar in surface or slightly convex, as shown in FIG. 6 of the '342 patent. In either instance, in a view along the crest perpendicular to the insert center line, the vertical lines running from the top to the bottom of the flank face were always straight.

In addition, the intersection between the corner radii and the tip radius, as well as the intersection between the conical surface and the flank faces, usually have a blending radius, also known as a round, to eliminate the sharp edge that would otherwise exist.

The shortcomings with this feature is that blend radii are areas of high stress concentration because they are small, typically 0.005 to 0.090 of an inch. These small blend radii typically contribute to or cause the premature breakage of an insert, of which in many cases, a less optimum material composition is utilized to overcome this failure mode.

In U.S. Pat. No. 4,108,260, a chisel type insert is shown in which the trailing flank is rounded outwardly. Unfortunately, the interfacing of the flank surfaces with the conical and crest are very sharp, and at best, would call for rounds or blends, as shown in the earlier '342 patent.

SUMMARY OF THE INVENTION

The present invention obviates the shortcoming with chisel type inserts by eliminating blend radii from the cutting tip and the high stress concentrations associated therewith.

The present invention also replaces the traditional flanks and conical surfaces with a contoured surface that omits the sharp intersections of the prior art inserts that require a blend radius or round. This contoured surface comprises a leading section, a trailing section and two side sections. All sections have contoured surfaces in which vertical lines located on the surfaces are bowed outwardly in a convex manner. The amount of curvature of the vertical lines varies, the amount for the leading and trailing sections preferably being greater than that of the two side sections.

An advantage of the present invention is that by utilizing the bowed-out sections, the insert crest can be kept relatively sharp without sacrificing a large reduction in cross-sectional area below the crest. This enables the insert to have greater design flexibility, more durability and a greater rate of penetration.

Another advantage of the present invention is that the insert can be a depth limiter in that the insert extension can be increased without increasing the penetration of the insert into the formation.

The above noted objects and advantages of the present invention will be more fully understood upon a study of the following description in conjunction with the derailed drawings.

DESCRIPTION OF THE PREFERRED EMBODIMENTS AND BEST MODE FOR CARRYING OUT THE INVENTION

Figure 1:
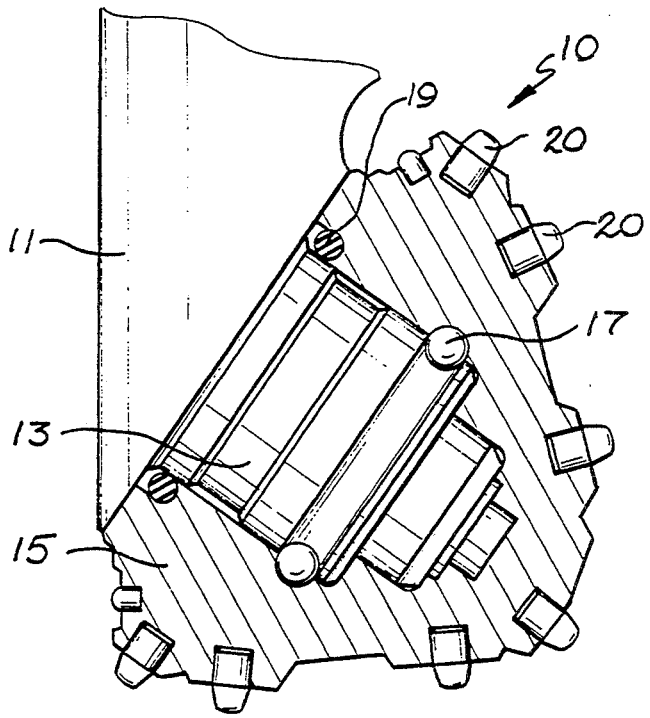
FIG. 1 is a fragmentary view, partially in section, of one leg of a rolling cone rock bit.
Figure 2:
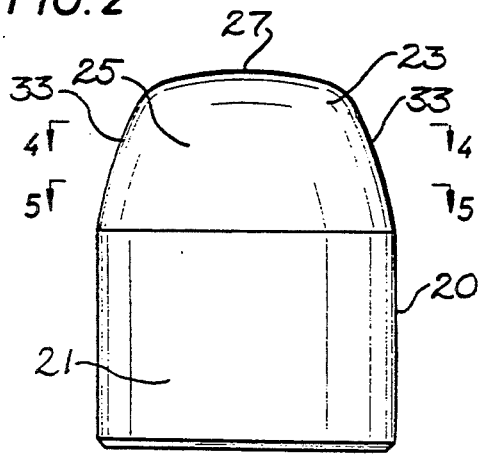
FIG. 2 is a front elevational view of the insert of the present invention.
Figure 3:
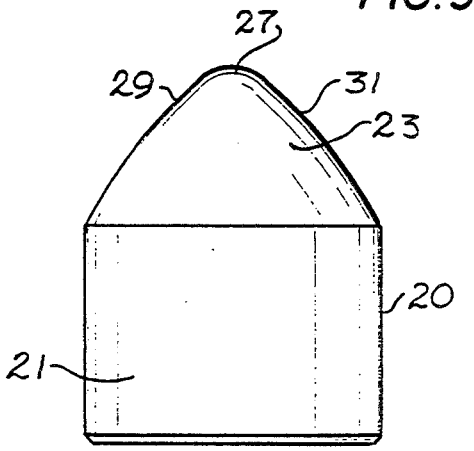
FIG. 3 is a side elevational view of the insert of the present invention.

FIG. 1 illustrates a portion of a rolling cone rock bit 10 having a leg 11 extending downwardly from a bit main body (not shown). A journal 13 extends from the leg 11 for rotatively supporting a cone 15. The journal 13 includes friction bearing surfaces which mate with corresponding bearing surfaces on the interior of the cone 15.

A plurality of ball bearings 17 are located within a chamber formed by registering grooves located on the journal and within the cone. The balls function to retain the cone on the journal.

An o-ring 19 is positioned within a gland formed by the journal and the cone to seal the interior of the cone from the exterior of the bit.

Although only one leg and cone assembly is shown, each rock bit normally includes two or three such assemblies.

Each cone 15 includes a plurality of cutting inserts 20 located in rows to project out of the borehole and the bit and cone rotate. Each insert 20 is usually made of a hard material such as sintered tungsten carbide.

FIGS. 2–5 illustrate an insert 20 made in accordance with the present invention. Each insert includes a cylindrical base 21 which is adapted to extend within a bore formed in the cone 15. Each insert 20 also includes a cutting tip 23 which is adapted to extend beyond the surface of the cone 15.

The cutting tip 23 includes a continuous surface 25 extending upwardly from the base 21 and terminating at its uppermost extremity forming a curvilinear crest 27. The crest 27 is elongated and the insert 20 is oriented on the cone 15 to enable the crest 27 to be normal to the direction of movement of the cone surface as the cone rotates. The crest 27 is preferably formed by a semi-circular curved surface formed along its length thereof with the ends of the crest 27 being formed by a semi-circular curve of the same or greater radius.

The crest 27 is also bowed upwardly in an arcuate shape with an apex being formed at the center thereof.

The continuous surface below the crest 27 can be divided into a forward or leading section 29, a rear or trailing section 31 and two side sections 33.

The forward section 29 includes vertical line segments extending from the base 21 to the crest 27 which are bowed outwardly in a convex manner. (See FIG. 3.)

Similarly, the trailing section 31 includes vertical line segments which are bowed outwardly in a convex manner. The amount of convex vertical curvature of both the forward and trailing sections are preferably identical.

Figure 4:
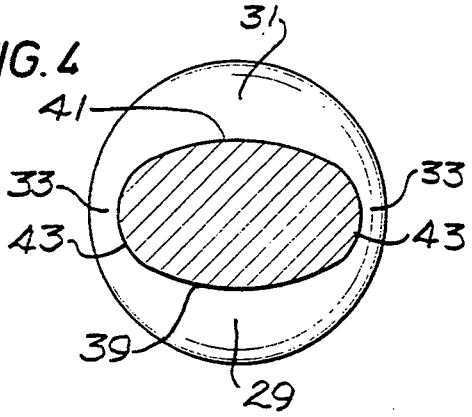
FIG. 4 is a sectional view of the insert, looking down from the top, taken along lines 4—4 of FIG. 2.
Figure 5:
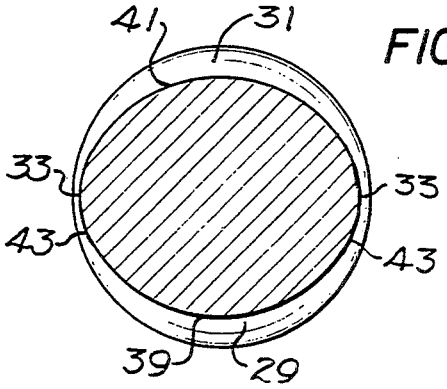
FIG. 5 is a sectional view of the insert, looking down from the top, taken along lines 5—5 of FIG. 2.

As shown in FIGS. 4 and 5, the horizontal line segments 39 and 41 of the leading and trailing sections 29 and 31 are substantially arcuate in shape, and when combined with the horizontal line segments 43 of the side sections 33, form ellipses.

Each side section 33 includes vertical line segments extending from the base 21 to the crest 27 which are bowed outwardly in a convex manner with the amount of curvature being less than the curvature of the leading and trailing sections 29 and 31. (See FIG. 2.)

As can be seen, the curved side surface of the cutting tip 23 is bowed outwardly around the entire periphery thereof (the leading and trailing sides to a greater extent).

By utilizing this bowed out feature on the flanks and sides, the insert nose radius can be kept relatively sharp without sacrificing a large reduction in cross-sectional area below the curvilinear crest. This also will allow for a more durable insert. Moreover, a smaller nose radius will enhance the bits rate of penetration.

It should also be noted that this design provides a continuous insert cutter surface which transitions with the crest 27 without any sharp intersections requiring blending being formed to create stress risers.

In the preferred embodiment, all of the vertical line segments are bowed out, however, the benefit of the invention can be obtained by bowing out only the trailing and leading line segments of the flanks.

It will of course be realized that various modifications can be made in the design and operation of the present invention without departing from the spirit thereof. Thus while the principal preferred construction and mode of operation of the invention have been explained in what is now considered to represent its best embodiments which have been illustrated and described, it should be understood that within the scope of the appended claims the invention may be practiced otherwise than as specifically illustrated and described.

What is claimed is:

1. In combination with a rolling cone drill bit of the insert type, a shaped insert having a cylindrical base integrally joined to a cutting tip, the cutting tip being a continuous surface extending from the base and converging to a crested apex, the continuous surface having vertical sections being bowed outwardly in a convex manner completely about the periphery thereof.

2. The invention of claim 1 wherein the cutting tip includes a leading and trailing flank and sides therebetween and said crested apex is oriented normal to the direction of movement of the insert on the cone, the cutting tip being bowed outwardly along the leading and trailing flanks thereof to a greater degree than the sides thereof.

3. The invention of claim 1 wherein the cutting tip surface below the crested apex is shaped to have a continuous contoured surface without any sharp intersections requiring blend radii.

4. In combination with a rolling cone drill bit of the insert type, a shaped insert having a cylindrical base integrally joined to a cutting tip, the cutting tip being a continuous surface extending from the base and converging into a crested apex, the crested apex being oriented normal to the direction of movement of the insert on the cone and having a leading side and a trailing side and sides therebetween, the leading side of the cutting tip including arcuate lined segments extending between the crested apex and the cylindrical base, said segments being bowed outwardly in a convex manner, the trailing side of the cutting tip includes arcuate lined segments extending between the crested apex and the cylindrical base, said segments being bowed outwardly in a convex manner, and the sides of the cutting tip between the leading and trailing sides includes arcuate lined segments extending between the crested apex and the cylindrical base, said segments being bowed outwardly in a convex manner.

5. The invention of claim 4 wherein the sides of the cutting tip being bowed outwardly a lesser extent than the leading and trailing sides thereof.

6. The invention of claim 4 wherein the cutting tip surface below the crested apex is shaped to have a continuous contoured surface without any sharp intersections requiring blend radii.

7. The invention of claim 4 wherein the cutting tip surface below the crested apex is shaped to have a continuous contoured surface without any sharp intersections requiring blend radii.

* * * * *